US007354222B2

(12) United States Patent
Satzler

(10) Patent No.: US 7,354,222 B2
(45) Date of Patent: Apr. 8, 2008

(54) BELTED ASPHALT COMPACTOR

(75) Inventor: Ronald L. Satzler, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/366,857

(22) Filed: Mar. 2, 2006

(65) Prior Publication Data

US 2006/0147267 A1 Jul. 6, 2006

Related U.S. Application Data

(63) Continuation of application No. 10/915,056, filed on Aug. 10, 2004, now abandoned.

(51) Int. Cl.
*E01C 19/22* (2006.01)

(52) U.S. Cl. ..... 404/125; 404/126; 280/405.1; 280/419; 280/442; 180/9.46

(58) Field of Classification Search ..... 280/400, 280/405.1, 406.1, 419, 442, 456.1, 460.1, 280/467, 472, 492; 404/122, 125, 126, 128; 180/6.7, 9.1, 9.46

See application file for complete search history.

(56) References Cited

U.S. PATENT DOCUMENTS

| | | | | | |
|---|---|---|---|---|---|
| 185,557 | A | * | 12/1876 | Lord | 404/126 |
| 2,132,107 | A | * | 10/1938 | Hamm | 404/126 |
| 2,691,927 | A | * | 10/1954 | Denton | 172/115 |
| 3,265,146 | A | | 8/1966 | Tucker | |
| 3,473,619 | A | | 10/1969 | Dion | |
| 3,686,763 | A | * | 8/1972 | Soe | 33/19.2 |
| 3,696,878 | A | | 10/1972 | Nelson | |
| 3,947,142 | A | * | 3/1976 | Takata et al. | 404/126 |
| 3,966,345 | A | * | 6/1976 | Kofel | 404/126 |
| 4,033,427 | A | * | 7/1977 | Sturesson | 180/424 |
| 4,471,850 | A | * | 9/1984 | Rotz | 180/420 |
| 4,505,349 | A | * | 3/1985 | Murphy | 180/420 |
| 4,737,050 | A | | 4/1988 | Abd. El Halim | |
| 4,909,341 | A | * | 3/1990 | Rippingale et al. | 180/9.1 |
| 5,337,833 | A | * | 8/1994 | Rizzo | 172/520 |
| 5,562,175 | A | * | 10/1996 | Bjorsne et al. | 180/419 |
| 5,894,901 | A | | 4/1999 | Awamura et al. | |

(Continued)

FOREIGN PATENT DOCUMENTS

WO WO 98/12386 3/1998

OTHER PUBLICATIONS

Otto J. Svec & A.O. Abd El Halim; Field Vertification of a New Asphalt Compactor, AMIR; Can. J. Civ. Eng. 18; Nov. 21, 1990; pp. 465-171; Ottawa, Ont, Canada.

(Continued)

*Primary Examiner*—Gary S. Hartmann
(74) *Attorney, Agent, or Firm*—Liell & McNeil

(57) ABSTRACT

A belted asphalt compactor and method are provided. The compactor includes a first unit with a roller frame. A second unit is coupled to the first unit, and is generally identical thereto. At least one mid roller and two end rollers are mounted in the roller frames, and a compactor belt extends about the rollers. Load adjusters are associated with each of the units and operable distribute a load among the rollers. A steering system is operable to rotate one of the first unit and the second unit about a vertical axis relative to the other unit.

10 Claims, 6 Drawing Sheets

U.S. PATENT DOCUMENTS

| | | | | |
|---|---|---|---|---|
| RE36,284 | E | 8/1999 | Kelderman | |
| 6,132,133 | A | 10/2000 | Muro et al. | |
| 6,345,932 | B1 * | 2/2002 | Fix | 404/126 |
| 6,350,082 | B1 | 2/2002 | Rickards | |
| 6,857,816 | B2 | 2/2005 | Saito et al. | |

OTHER PUBLICATIONS

Ian Richards; Implementation of HIPAC a Revolutionary Asphalt Compaction Technology; Pioneer Road Services Pty Ltd; pp. 282-300; Australia.

* cited by examiner

BELTED ASPHALT COMPACTOR

This is a continuation of patent application Ser. No. 10/915,056, filed Aug. 10, 2004 now abandoned with the same title.

TECHNICAL FIELD

The present disclosure relates generally to compactors for compacting paving materials, and relates more particularly to a steerable belted asphalt compactor.

BACKGROUND

The process of asphalt compaction for roads, walkways and parking lots has for many years been performed with rolling vehicles having a plurality of cylindrical metal rollers. Compactor work machines having large front and rear drums are a familiar sight in construction zones. In a typical operation, an asphalt paver travels along a prepared bed of gravel, concrete or soil and distributes a layer of hot asphalt in an approximately uniform thickness. Once the asphalt has cooled to an acceptable level and sufficient viscosity, a rolling compactor is passed across the asphalt layer to smooth and compact it. Such work machines are typically relatively heavy to assist in squeezing the asphalt to a hard, uniform surface suitable for road traffic. Depending upon the specific composition, freshly laid asphalt tends to be relatively soft, and workers are therefore forced to wait a significant length of time before the asphalt can withstand the weight of a conventional roller compactor.

One particular problem with soft asphalt is described as a "bow wave" or bulge of asphalt that can form and persist in front of a conventional roller compactor as it travels across the fresh asphalt, pushing the bow wave ahead of the front roller. During a large scale paving operation, the asphalt paver can travel far enough ahead of the compactors that the fresh asphalt has sufficient time to cool and harden before the compactors begin their work. Toward the end of a working day, however, workers are often forced to shut down the pavers well in advance of compaction, allowing the asphalt to cool sufficiently to be compacted, but losing valuable production time.

In recent years, belted asphalt compactors have received increased attention. Compacting the asphalt with a belted work machine offers the advantage of distributing the weight of the machine or the "load" over a larger surface area. Accordingly, the compactor does not sink into the newly laid soft asphalt as readily as a conventional roller compactor. The bow wave phenomenon is much reduced, and less time is required between laying the fresh asphalt and compacting it into a finished product, increasing productivity. Moreover, compaction of softer asphalt is believed to result in tighter compaction and a more aesthetically pleasing surface finish.

A challenge in working softer asphalt with a belted compactor is that turning of the work vehicle is difficult to perform without "scuffing" the asphalt surface as the belt is rotated. The relatively large asphalt contact surface of the belt must slip across the asphalt surface to effect a turn, and in theory, slipping can occur any time the belt rotates relative to the asphalt, risking scuffing.

The actual slip velocity of the belt relative to the asphalt, vehicle weight, and tendency for a particular asphalt—belt interface to scuff are proportional to the risk and degree of scuffing. The relative slip velocity at different positions along a compactor belt—asphalt interface will vary depending upon the particular position relative to a turning axis of the belt. The term "yaw" is used to describe a directional turning of a work vehicle or component such as an asphalt compactor. Thus, the yaw rate, or relative speed at which a belted compactor turns relative to the asphalt surface, is generally proportional to the risk and degree of scuffing.

One known belted compactor design utilizes an elongate belt extending about relatively large front and rear rollers rotating about parallel axes at opposite ends of the compactor. When it is desirable to turn the vehicle, one or both of the rollers are displaced from their axis of rotation by pivoting the same relative to the frame of the work machine, similar to turning a conventional non-belted rolling compactor. Relative displacement between the roller axes by necessity stretches the belt, increasing the belt tension along the outer side of the machine relative to its turning radius, and decreasing the tension along the opposite side. Further still, it is challenging to guide the belt over the rollers during a steering maneuver, as the belt will have a tendency to continue in its straight line direction of travel even as the rollers are turned.

One system for addressing the belt guiding challenge utilizes guide blocks attached to an inside surface of the belt. Rather than single front and rear rollers, the respective rollers are split into two separate rollers having a gap between them that accommodates the guide blocks. As the vehicle is turned, the guide blocks extend into the gap and continuously urge the belt toward its desired orientation. One drawback to such a design is that the vehicle weight or load is concentrated under the split rollers, leaving a strip of less-compacted asphalt under the area of the belt corresponding to the guide blocks.

Another known design uses an articulated dual belt compactor. A front unit and rear unit are coupled together, and a steering apparatus is positioned between the same. When it is desirable to steer the vehicle, the two units are rotated about a steering axis between the tracks, typically extending through the operator platform. In many articulated steering work machines, compactors or otherwise, the rear track briefly moves in a direction opposite the selected turning direction before it begins to follow the front track. This phenomenon is similar to a conventional tow trailer that pivots slightly about an axis between the tow vehicle and trailer prior to following the tow vehicle through a turn. Thus, the rear unit actually performs two steering maneuvers any time the complete machine makes a single steering maneuver. The asphalt has an increased risk of scuffing in areas where the articulated vehicle turns due to this phenomenon.

A further limitation of such a design relates to the capacity, or lack thereof to laterally drive the work vehicle off of the asphalt work surface. With articulation steer, it may be necessary to back the vehicle back and forth several times before it is completely driven off of the asphalt surface, or turn the vehicle about only a very small turning radius.

SUMMARY OF THE DISCLOSURE

In one aspect, the present disclosure provides an asphalt compactor that includes a first unit having a plurality of rollers mounted thereto and a compactor belt extending about the same. At least one of the rollers of the first unit is a drive roller. A second unit is coupled to the first unit. The compactor further includes a steering system operable to rotate one of the first unit and the second unit about a vertical axis relative to the other of the first unit and the second unit. A load adjuster is provided that is operable to distribute a load among the rollers in a plurality of distributions.

In another aspect, the present disclosure provides an asphalt compactor that includes a first unit having a roller frame with at least one mid roller and two end rollers mounted therein, and a first compactor belt extending about the same. A first load adjuster is provided and is operable to distribute a load among the rollers of the first unit in a plurality of distributions. A second unit is coupled to the first unit and includes a roller frame with at least one mid roller and two end rollers mounted therein, and a second compactor belt extending about the same. A second load adjuster is provided and is operable to distribute a load among the rollers of the second unit in a plurality of distributions. A steering system is provided and is operable to rotate one of the first unit and the second unit about a vertical axis relative to the other of the first unit and the second unit.

In yet another aspect, the present disclosure provides a method of operating a belted asphalt compactor. The method includes the steps of coupling a first unit to a second unit, wherein at least one of the first unit and the second unit includes a compactor belt extending about a plurality of rollers, and steering the compactor at least in part by redistributing a load on the belt.

DETAILED DESCRIPTION

Figure 1:
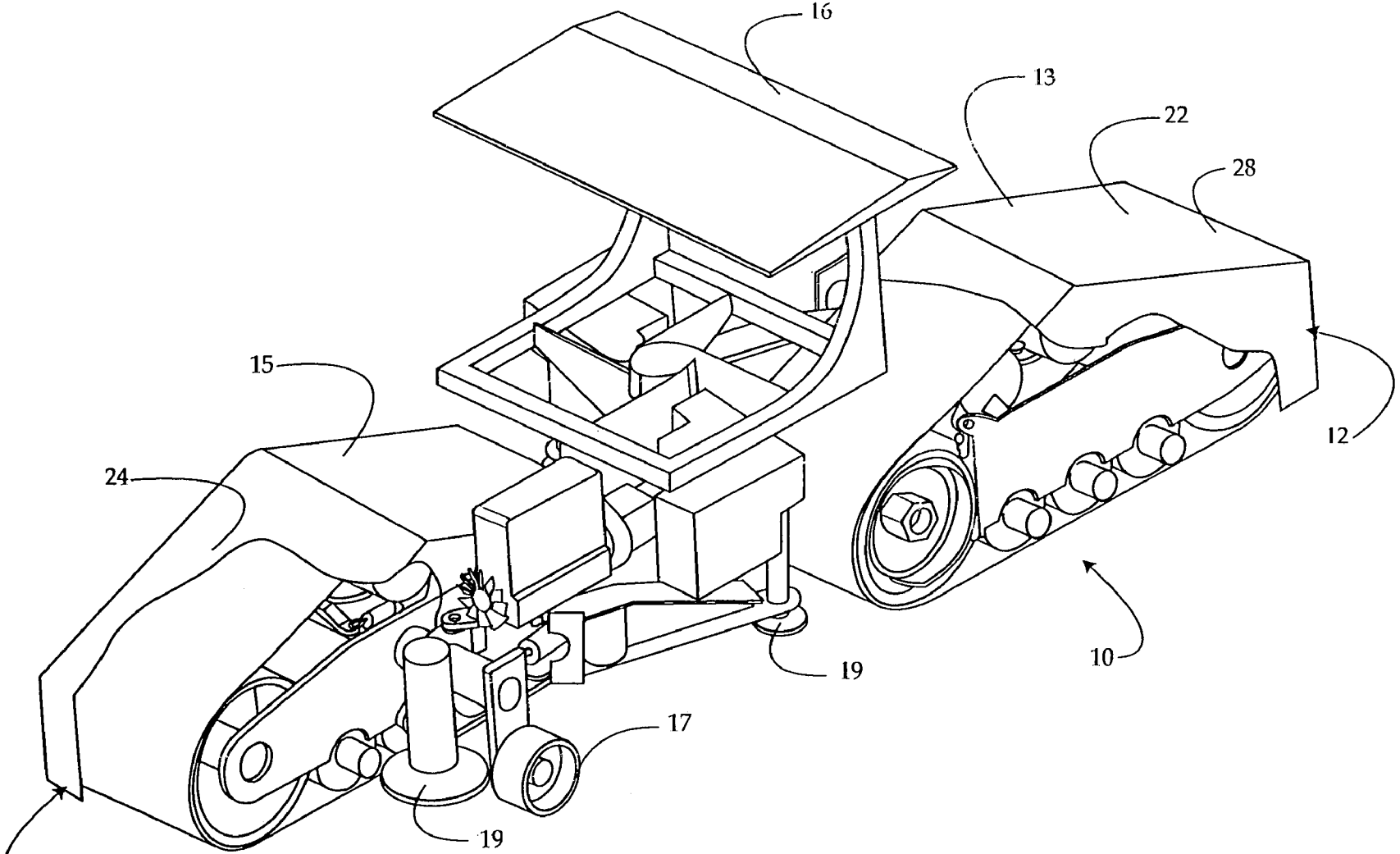
FIG. 1 is a perspective diagrammatic view of a belted asphalt compactor according to an embodiment of the present disclosure.
Figure 2:
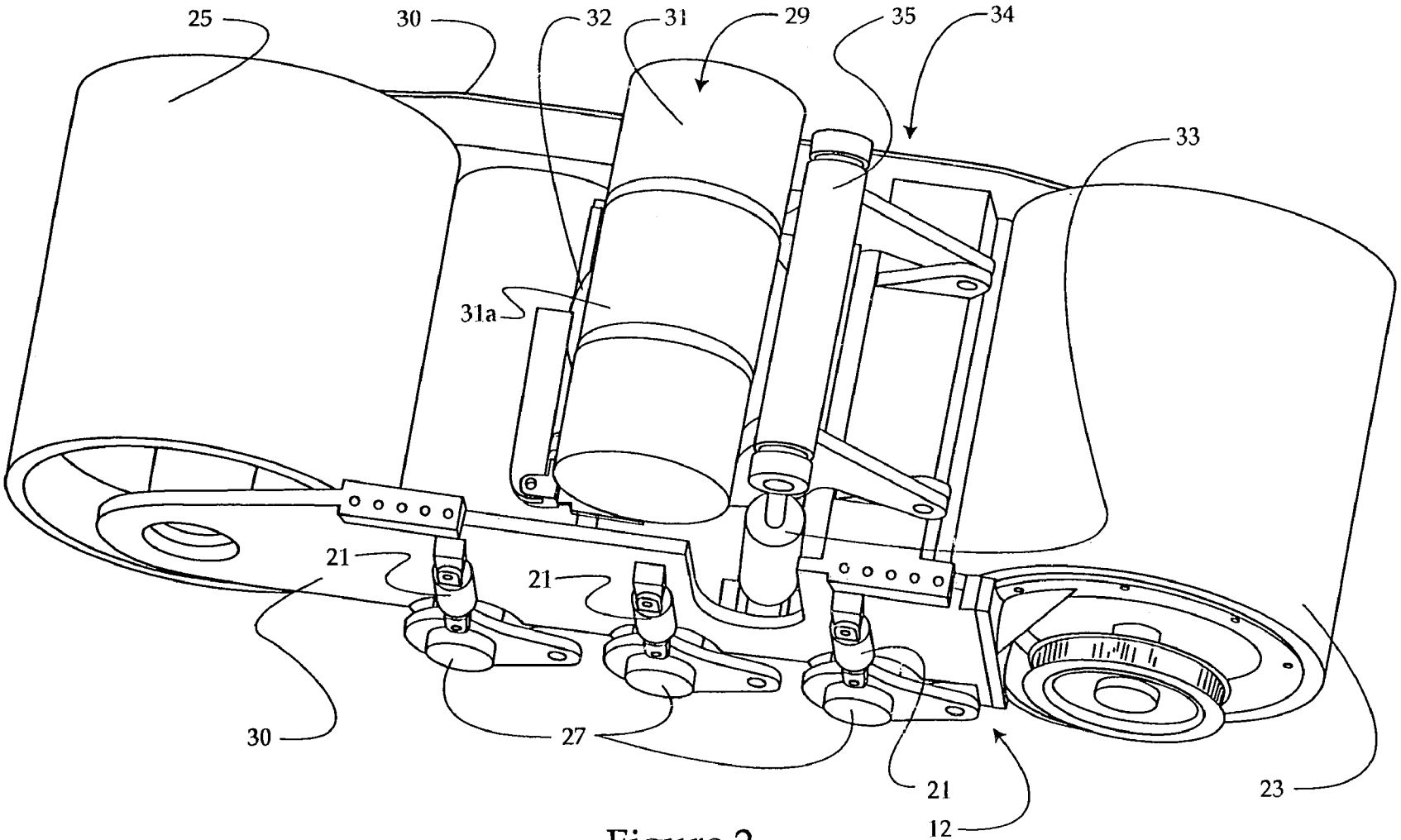
FIG. 2 is a perspective diagrammatic view of one of the units from FIG. 1 with the belt removed.
Figure 3:
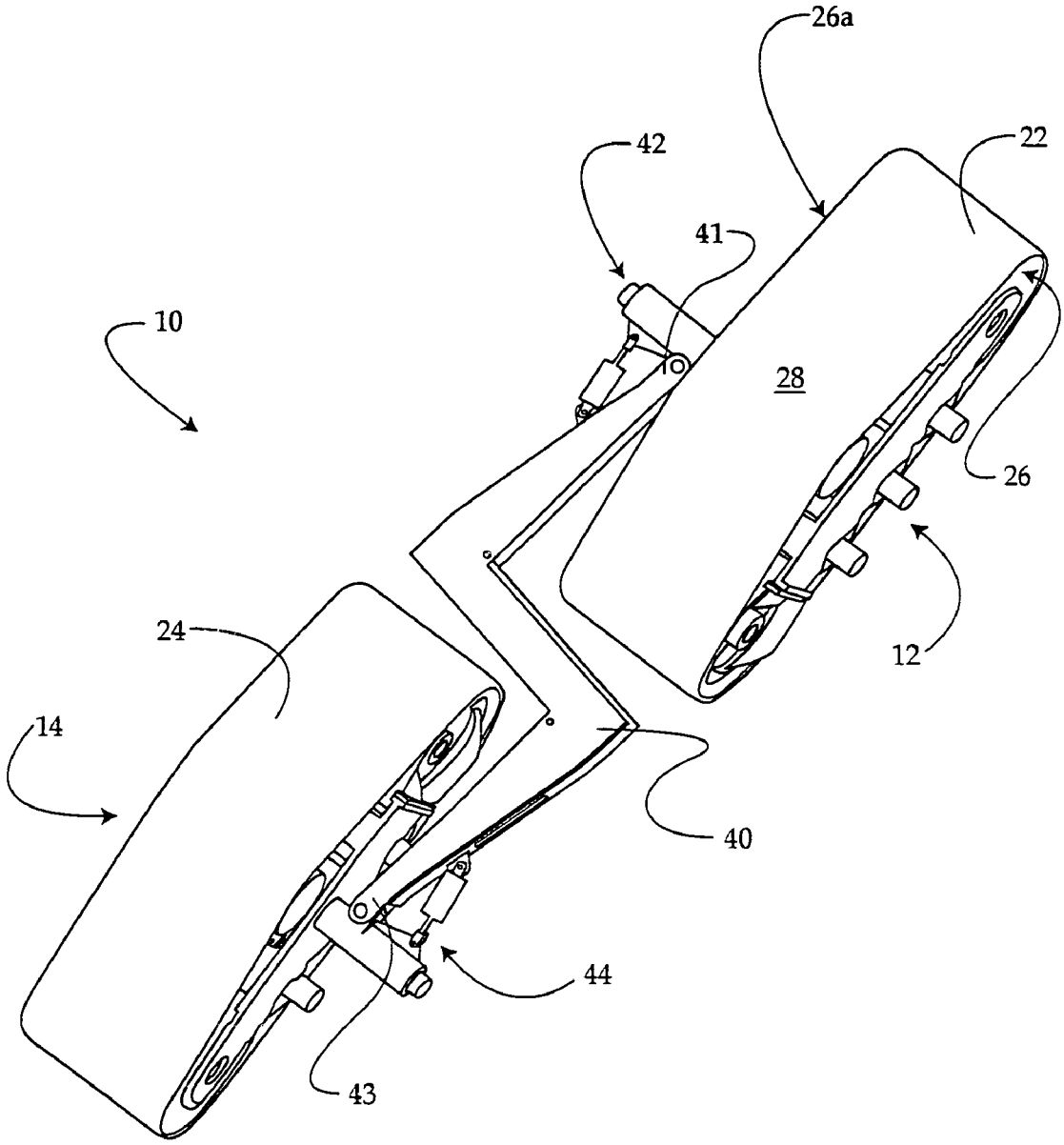
FIG. 3 is a partial perspective diagrammatic view of the asphalt compactor of FIG. 1.

Referring to FIGS. 1-3, there are shown various perspective views of a two track belted asphalt compactor 10 according to one embodiment of the present disclosure. Compactor 10 includes a first unit 12 and a second unit 14 coupled to the first unit. During operation, units 12 and 14 are preferably driven across a work surface to compact relatively freshly laid asphalt. An operator platform 16 is mounted between the first 12 and second 14 units and will preferably support a compactor driving and control system (not shown). A first hood 13 (partially shown) may be positioned over first unit 12, whereas a second hood 15 (partially shown) may be positioned over second unit 14. Hoods 13 and 15 cover and protect the various components of compactor 10 from debris and the elements, and also assist in maintaining the belts, described below, at a desired operating temperature. A balancing wheel 17 is preferably provided with both units (only one is illustrated in FIG. 1), and extends laterally thereof to prevent tipping of compactor 10. A plurality of jacks 19 are preferably provided and utilized to jack compactor 10 completely off the ground for heating of the belts, as described herein or servicing. Jacks 19 may be of varying sizes, including larger jacks for lifting compactor 10 and smaller jacks, for example on swing arms, for balancing.

Compactor 10, with its hoods removed, reveal first 22 and second 24 tracks or compactor belts associated with each of units 12 and 14, respectively. Belts 22 and 24 extend about a plurality of rollers, described herein, and provide the compacting surface that actually engages with the work surface. Belts 22 and 24 are preferably formed from any suitable flexible, and preferably elastomeric, material that is sufficiently flexible to roll about the associated units, but strong enough to withstand the mechanical forces inherent in heavy construction work and having a temperature resistance sufficient to withstand working on hot asphalt.

FIG. 2 illustrates first unit 12, preferably substantially identical to second unit 14 with belt 22 removed. The description herein of first unit 12 should be understood to apply similarly to unit 14. As illustrated, unit 12 includes a plurality of rollers mounted in a roller frame 30. Belt 22 extends about the plurality of rollers, including two end rollers 23 and 25, mounted at opposite ends of frame 30, and a plurality of mid rollers 27, preferably three mid rollers. At least one of the plurality of rollers is preferably a drive roller, as is the case with unit 14. End rollers 23 and 25 are both preferably drive rollers, and mid rollers 27 are passive with respect thereto, however, embodiments are contemplated wherein only one of end rollers 23 and 25 are drive rollers or where one or more of mid rollers 27 serves as a drive roller in addition to or instead of one or both of end rollers 23 and 25.

In the embodiment of FIG. 2, mid rollers 27 are all similar in size and have a diameter less than a diameter of end rollers 23 and 25, also preferably similar in size to one another. A plurality of actuators 21 are preferably mounted to frame 30 and operable to adjust a load carried by each of mid rollers 27. In a preferred embodiment, actuators 28 can exert force individually on each of rollers 27, lifting end rollers 23 and 25 clear of the compacting surface when desired, or simply increasing the proportion of the weight of unit 12 carried by each of rollers 27.

A lateral belt guide 29 is preferably mounted above roller frame 30 and serves the dual purposes of tensioning the belt and laterally guiding the same. FIG. 2 illustrates a tensioning apparatus 34 connected to one or more actuators 33 operable to adjust a vertical position of belt guide 29, and hence a tension of belt 22. Referring also to FIG. 3, belt 22 preferably includes first and second edges 26*a* and 26*b*, respectively, an outer surface 28, which may be substantially smooth, and an inner surface best seen in FIG. 1. Belt guide 29 preferably includes a plurality of adjacent rotatable drums 31 positioned against the inner surface of belt 22. Those skilled in the art will appreciate that alternative embodiments are possible wherein drums 31 are positioned against outer surface 28 of belt 22. Tensioning apparatus 34 preferably includes at least one actuator 33 mounted to frame 30 and operable to provide an upward force on drums 31 via a support arm 35 to tension belt 22 to a desired extent. For servicing of compactor 10, or switching belt 22, actuator 33 is preferably operable to completely de-tension belt 22, allowing it to be removed.

Drums 31 are preferably pivotable or re-orientable about a vertical axis, most preferably a single axis intersecting a center drum 31*a*, allowing drums 31 to pivot as a unit under belt 22 to laterally guide the same as described herein. A pivotable support plate 32 is provided beneath center drum 31*a*. A pivot actuator (not shown) can move belt guide 29 clockwise or counterclockwise to influence the lateral position of the belt, as described herein. Those skilled in the art will appreciate that alternative designs are contemplated wherein each drum is individually pivotable about a vertical axis.

A coupling 40, including first and second ends 41 and 43, laterally connects to first and second units 22 and 24, respectively. Coupling 40 preferably extends in a zigzag configuration between units 12 and 14, and is connected such that belts 22 and 24 can partially overlap a given section of asphalt during compactor operation, the degree of overlap being adjustable. A first steering system 42 is associated with first unit 22, and operable to steer first unit 12 relative to second unit 14 about an axis vertically oriented relative to the ground and laterally displaced from unit 12. A second steering system 44 is preferably operable to perform a similar function with respect to second unit 14. First and second steering systems 42 and 44 are preferably independently operable. Actuation of each steering system exerts a force on the unit it is associated with relative to coupling 40, and may also be thought of as operable to exert a force on its respective unit relative to the other of said units.

During a complete steering maneuver, first steering system 42 might be activated to urge unit 12 away from or toward coupling 40. Second steering system 44 can be locked, allowing simple re-orienting of units 12 and 14 relative to one another with second unit held stationary relative to coupling 40. Alternatively, second steering system 44 could be activated to urge unit 14 toward or away from coupling 40, allowing both units 12 and 14 to be turned in parallel or rotated in opposite directions. Where both first 12 and second 14 units are steered simultaneously, each of the front and rear of said units 12 and 14 is able to execute a single steering maneuver during a single steering maneuver of the complete compactor 10. This ability contrasts with a plural-unit articulated design, wherein the rear unit must briefly execute a first maneuver away from the steering direction of the front unit prior to executing a second maneuver to follow the front unit through the turn.

Where units 12 and 14 are turned in parallel, operation known in the art as "crab steer" is facilitated. Crab steer is the preferred mode of steering during normal operation, because it minimizes total slip under the belts as the machine is moved laterally for the next pass. Crab steering can also be used, for example, where it is desirable to drive compactor 10 off of the work surface with minimal travel. Rather than traversing a relatively long path across the work surface, or executing a multi-point turn, units 12 and 14 are rotated with respective to a compacting direction (for example, the linear road surface), and compactor 10 can be driven off of the work surface via the shortest feasible path.

Figure 4:
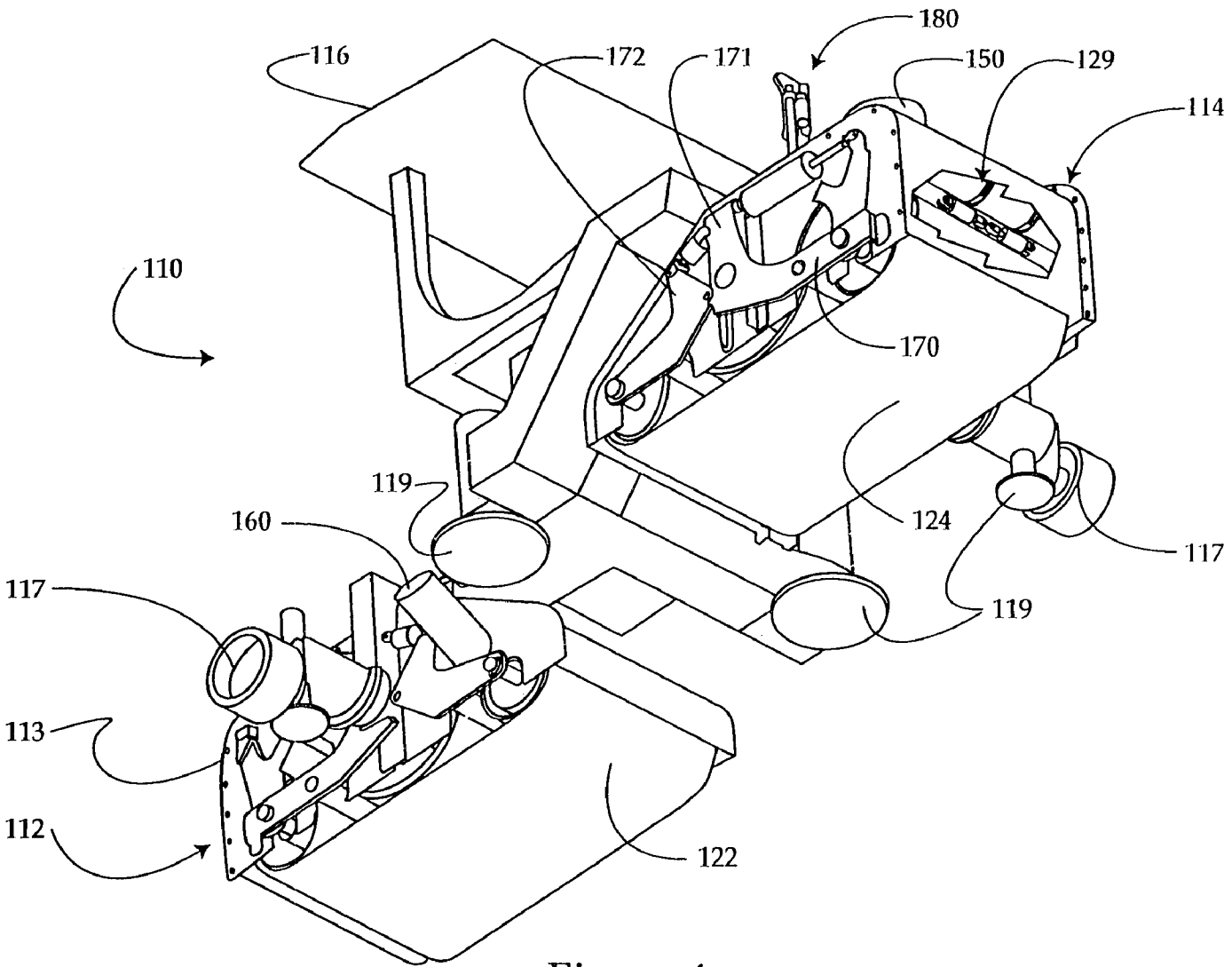
FIG. 4 is a perspective diagrammatic view of a belted asphalt compactor according to another embodiment of the present disclosure.
Figure 5:
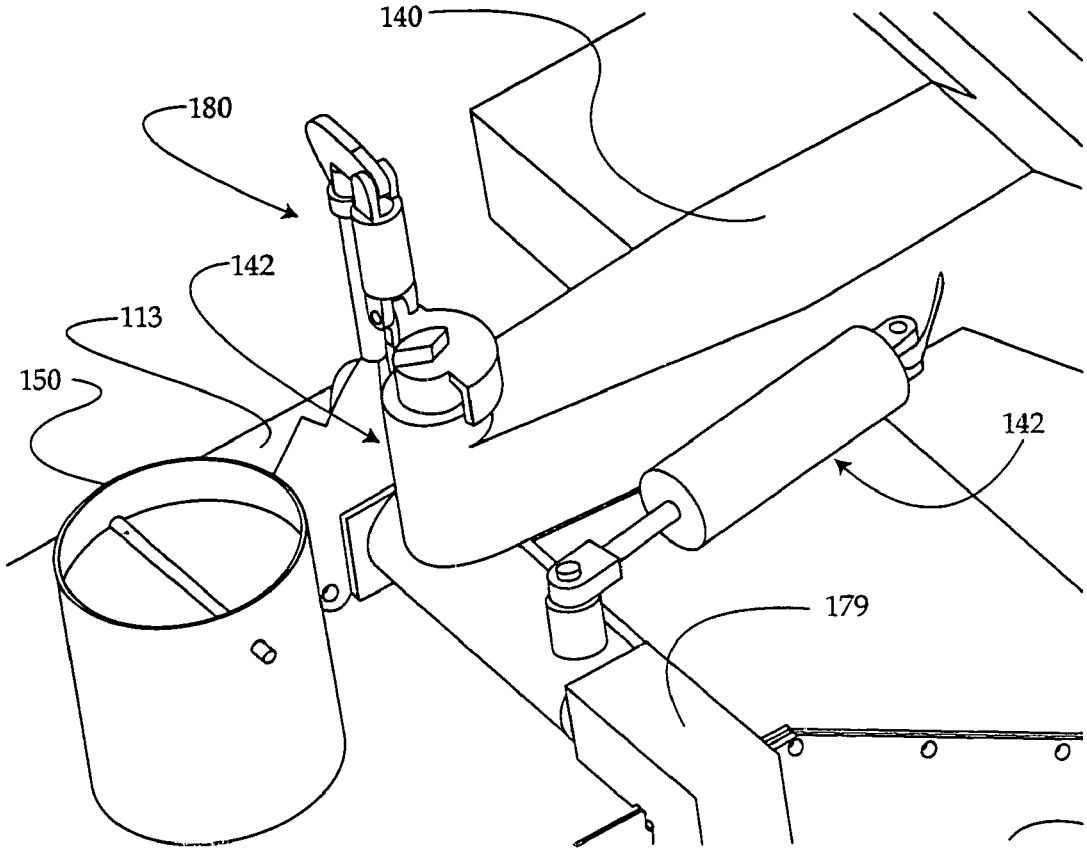
FIG. 5 is a partial perspective diagrammatic view of the asphalt compactor of FIG. 4.
Figure 6:
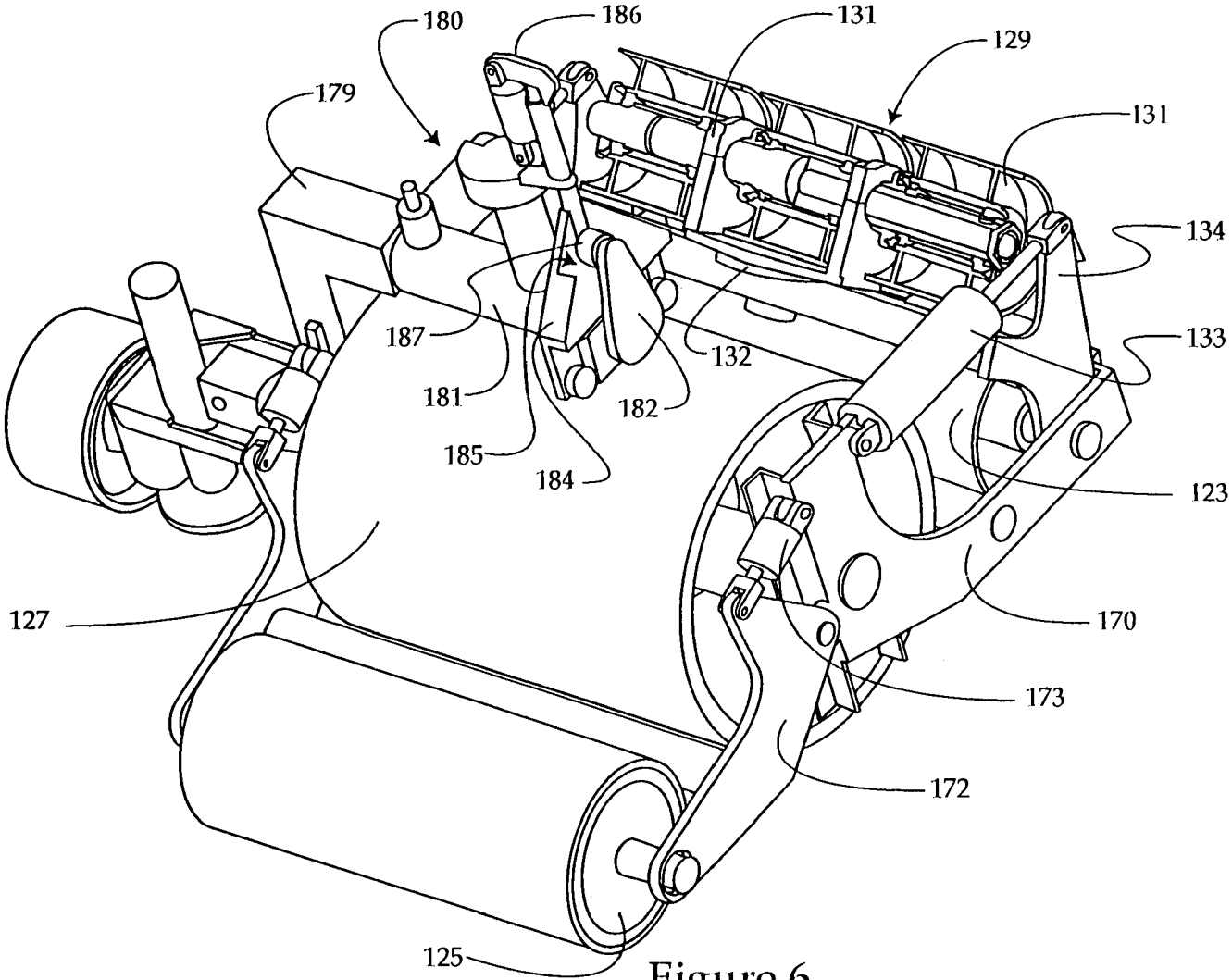
FIG. 6 is a perspective diagrammatic view of one of the units, with belt removed, of the asphalt compactor of FIG. 4.

Referring to FIGS. 4-6, there are shown various views of a belted asphalt compactor 110 according to a second embodiment of the present disclosure. Compactor 110 includes a first unit 112 and a second unit 114 and first 122 and second belts 124 associated respectively therewith. A first hood 113 covers first unit 112 whereas a second hood 115 covers second unit 114. Compactor 110 is equipped with a plurality of jacks 119, similar to jacks 19 of previously described compactor 10, a plurality of balancing wheels 117 and an operator platform 116. Similar to compactor 10, first and second units 112 and 114 are preferably generally identical. A steering system 142, shown in FIG. 8, is operable to steer first unit 112 relative to a coupling 140 about a steering axis extending through unit 112. A pitch control system 180, operable to control a pitch of first unit 112. Second unit 114 is also preferably equipped with a pitch control system, and the description of pitch control system 180 herein should be understood to apply also to second unit 114. Compactor 10 is also preferably equipped with pitch control systems (not shown), and the present description is therefore also applicable thereto. One difference between compactor 110 and compactor 10 is a two-part roller frame 170 in each of the units 112 and 114 having a front 171 and rear 172 frame portion, said frame portions being pivotable relative to one another.

A heat inlet 160 is provided on hood 113, and used to deliver heated gas, for example, from burning diesel fuel, to heat belt 122 to a temperature suitable for compacting freshly laid asphalt. The use of diesel fuel and an onboard heating apparatus allows only a single fuel type to be carried onboard. A vent 150 is provided in the top of hood 113 for venting gases passed therethrough during heating of belt 122 to avoid accumulation of a combustible mixture within hood 113.

As described, compactor 110 includes a frame 170 having a front portion 171 and a rear portion 172, said portions pivotable relative to one another. Compactor 110 further includes at least one actuator 173, preferably one actuator on each side of the roller frame 172, 170, operable to pivot front portion 171 and rear portion 172 relative to one another, thereby adjusting or redistributing a load among the plurality of rollers. It should be appreciated that the terms "front" and "rear" are relative as used herein and should not be taken as limiting, as all of the described embodiments are intended to function equally well in both directions of travel. Rear portion 171 preferably includes a mid roller 127 rotatably mounted therein, as well as a first end roller 123. A second end roller 125 is rotatably mounted in rear portion 171. Mid roller 127 is preferably a drive roller.

A lateral belt guide 129 adjacent end roller 123. Belt guide 129 is constructed and functions similar to belt guide 29 of compactor 10, and includes a pivotable support plate 132 upon which is mounted a plurality of rotatable drums 131. A belt tensioning actuator 133 is provided, and is coupled to a support apparatus 134 to adjust a tension of belt 122. Belt 122 preferably approaches and leaves drums 131 at equal angles. A first belt portion 122*a* at a first side of drums 131 is oriented at approximately 90° relative to a second belt portion 122*b* at a second side of drums 131. An axis of rotation of pivot plate 132 is oriented at 45° relative to first belt portion 122*a* and second belt portion 122*b*, and thus bisects the angle defined thereby. The 90° angle between the respective belt portions is exemplary only, and those skilled in the art will appreciate that other belt configurations are possible so long as the axis of rotation of the pivot plate 132 (and drums 131) bisects the angle of the belt passing over the rollers. Lateral belt guide 29 of previously described compactor 10 preferably is similar to belt guide 129 of compactor 110, and the describe preferred orientation of belt 122 and the pivot axis of drums 131 is similarly applicable thereto.

The described relationship is not critical to operation of compactors 10, 110, but the lateral belt guides design described herein represents a preferred configuration for the respective belt guides 29, 129 of both of compactors 10, 110. In compactor 10, because of the relatively smaller mid rollers 27, the lateral belt guide 29 is preferably positioned between end rollers 23 and 25, rather than adjacent an end roller 125 as in compactor 110, and traverses less than 90° as it passes over drums 131. Still further embodiments are contemplated (not shown) wherein a lateral belt guide contacts the outer surface of the belt rather than the inner surface. A portion of a pivot actuator 139 for rotating support plate 132 to re-orient drums 131 may also be similar to a pivot actuation mechanism suitable for use with compactor 10.

During a steering maneuver, pivot actuator 139 is activated to rotate drums 31, 131 about an axis of rotation, urging belt 22, 122 in a desired travel direction. By re-orienting drums 31, 131, relative to the belt passing across the same, a lateral force is applied to the belt based upon the pivot direction of drums 31, 131. For instance, when compactor 10, 110 is executing a right turn relative to its straight line travel over the work surface, guide drums 31, 131 will be pivoted clockwise, thus re-orienting the rotation of drums 31, 131 toward the desired turn direction. As the inner surface of belt 22, 122 encounters the drums 31, 131, rotating at an angle relative to the travel direction of belt 22, 122, a frictional force there between will urge the belt 22, 122 in the desired turn direction of the vehicle. Because the axis of rotation of the drums preferably bisects the angle of belt 22, 122 passing across the same, pivoting of drums 31, 131 does not induce unequal tension along opposite edges of belt 22, 122.

Referring to pitch control 180, it preferably serves the dual purposes of adjusting the pitch tolerance of the associated unit 112 for different operating conditions, and locking its pitch relative to a coupling 140 for jacking of the unit 112 during heating or servicing. Pitch control system 180 preferably includes a pivot arm 181 fixed relative to coupling 140. Roller frame 170 preferably includes an extension 179 passing through pivot arm 181, and pivotable therein. A pitch arm 182 is preferably connected to extension 179, and extends transversely thereto. A roller 187 is mounted to the end of pitch arm 182 and positioned at least partially within a V-shaped slot 185 of a pitch plate 184.

As the associated unit pitches relative to coupling 140, roller 187 travels across slot 185, the direction depending upon the pitch direction of unit 112. Roller 187 restricts the allowable pitch by contacting sides of slot 185. A hinge 186 supports pitch plate 184 relative to roller 187. By varying the relative position of cam roller 187 in slot 185, the distance roller 187 can travel back or forth across the slot can be adjusted, in turn adjusting the pitch tolerance of unit 112 relative to coupling 140. Those skilled in the art will appreciate that pitch control system 180 is exemplary only, and alternative means might be employed for limiting or locking pitch of the compactor units. For example, pitch plate 185 might be adjusted relative to roller 187, or alternatively pitch arm 182 might be adjusted to vary the position of roller 187 in slot 185.

INDUSTRIAL APPLICABILITY

Referring to the drawing Figures generally, when it is desirable to begin an asphalt compacting process, compactor 10, 110 will preferably be transported to a point close to a work site for preparing the compactor for operation. Initially, first belt 22, 122 and second belt 24, 124 are heated to prepare them for contact with relatively freshly laid asphalt. Heating of the belts has been found to be desirable because it reduces the tendency for fresh, soft asphalt to adhere to the belts during operation. Once the compactor 10, 110 is in a working mode, and continuously passing over hot asphalt it is generally unnecessary to apply supplement heat to belts 22, 122, 24 and 124. Belt heating is typically performed by blowing heated air across the belts as they are rotated about their respective rollers. The description of compactor operation herein should be understood to refer equivalently to either of compactors 10, 110, except as otherwise stated. Similarly, specific description of features of first unit 12, 112 should be understood to refer also to second unit 14, 114, as the respective units of each of compactors 10 and 110 are preferably identical.

To perform the belt heating operation, it preferred to jack the entire compactor off of the ground, and slowly rotate the belts. It is further desirable to lock movement of first unit 12, 112 and second unit 14, 114 relative to coupling 40 when compactors 10, 110 are lifted off the ground for belt heating. Units 12, 112 and 14, 114 ordinarily are movable relative to coupling 40, 140, and relative to one another. When compactors 10, 110 encounter a slope during normal operation, it is necessary that each unit 12, 112 and 14, 114 be able to move relative to the other, and preferably relative to coupling 40, 140. For example, while both units 12, 112 and 14, 114 will be oriented substantially coplanar while compacting a flat work surface, once one of the units reaches a slope, the work surface below one of the units will lie in a different plane than the work surface below the other of the units, and at least one of the units 12, 112 and 14, 114 must pitch or tilt relative to the other unit to maintain both belts 22, 122 and 24, 124 in a desired contact with the work surface.

While it is desirable to allow each of the units 12, 112 and 14, 114 to "pitch," as described, it is also desirable to control the degree to which each of the units can pitch. Under some working conditions, it may be desirable to limit the pitch of each unit 12, 112, and 14, 114 for example when redistribution of a load on one or more of the belts 22, 122 and 24, 124 is effected. Were pitch unrestricted, redistribution of the load could cause an undesirable forward or backward tipping, or pitching of the unit, distributing the load on the belt in a manner other than that desired. As described herein, pitch control device 180 serves the dual purposes of adjusting pitch tolerance during operation, and locking the units 12, 112 and 14, 114 relative to coupling 40, 140, respectively for heating belts 22, 122 and 24, 124.

Returning to the belt heating process heat inlet 160 extends from hood 113 and can be connected with a heated air supply (not shown), for example, a diesel furnace, allowing hot air or exhaust to be blown into hood 113 and passed across belt 122, preferably as it rotates. During belt heating, vent 150 is preferably open to minimize the risk of accumulating combustible gases under hood 113, and is closed during compacting to help hold in heat and maintain the belt 22 at a desired operating temperature. All of units 12, 112, 14 and 114 are preferably equipped with a heat inlet similar to heat inlet 160. Once the belt heating process is complete, compactors 10 and 110 are lowered on jacks 19, 119 and driven onto the work surface.

Compactors 10, 110 are preferably passed across the asphalt surface in as straight a line as possible, also preferably having some degree of overlap between first belt 22, 122 and second belt 24, 124. Depending upon the asphalt properties, it is generally desirable to distribute load equally across the belt surface in contact with the asphalt during straight line operation. In certain circumstances, it could alternatively be desirable to distribute a load among the rollers unequally during straight line compacting. For example, reducing the relative load on the leading end rollers 25, 125, and correspondingly increasing the load on one or more of mid rollers 27, 127 and/or end rollers 23, 123 might be desirable. This particular load distribution scheme would have the effect of more gradually applying the compactor load to the asphalt than in an equal load distribution, reducing the tendency for a bow wave to form in front of the compactors 10, 110 in some instances. Similarly, when making a second pass across the work surface, or where the asphalt is relatively cool and firm it may be desirable to support most or all of the load on mid rollers 27, 127, for a final squeeze of the asphalt. Such an operation scheme would be generally similar to compacting asphalt with a conventional non-belted compactor.

When the work machine encounters a turn in the work surface, several things happen. Preferably, an onboard microprocessor (not shown) is continuously monitoring or calculating plural operating parameters, including vehicle speed, steering angle, steering system cylinder action, pivot angle, vehicle yaw rate and asphalt conditions. As the work machine begins to negotiate the turn the respective units are urged in the appropriate turning direction with steering systems 42 and 44 preferably by hydraulically pushing or pulling the associated unit relative to the coupling 40. If necessary, pitch control 180 can be adjusted to maintain each unit within a desired pitch tolerance.

Prior to or simultaneous with initiation of a turning maneuver, load adjuster 21 is activated to redistribute the load across belt 22 in compactor 10, or actuator 173 of unit 110. In general terms, the relative proportion of the load carried by mid rollers 27, 127 should be increased manually or by the microprocessor in proportion to the yaw rate of the associated belt, i.e. the rate at which the belt is rotated about a vertical axis.

Yaw rate is affected by two parameters, the yaw rate inherent in driving the compactor about a curve, and the yaw created by steering cylinder action. In other words, once the compactor begins to curve, each unit is rotating a certain degree relative to the work surface. As the steering cylinder pivots the unit relative to coupling 40, 140, it also contributes to the spatial rotation of the unit. During yaw, the slip velocity is different at different points under the belt, specifically the slip velocity increases with an increasing distance from a mid point thereof. However, the lower unit pressure under the belt at any given point, the less likely scuffing will occur at a given yaw rate. Thus, the lower the product of unit pressure and slip velocity, the less the compactor is likely to scuff the work surface. Accordingly, to minimize the likelihood of scuffing the asphalt, unit pressure is decreased in those areas of the belt displaced fore and aft from the mid point thereof, and increased under mid rollers 27, 127, those areas having relatively lower slip velocity for a given yaw rate.

Compactors 10 and 110 are preferably equipped with a plurality of sensors (not shown) for determining the properties of the asphalt to be compacted. For example, asphalt temperature and asphalt viscosity may both be measured to determine if the asphalt is suitable for compaction, and also allowing an operator to adjust the speed, load distribution among the rollers, turning rate and other parameters during compacting. Belt edge sensors (not shown) may also be provided to detect a lateral position of the belt edges, and adjust drums 31, 131 accordingly to re-orient the belt. Belt tension may also be adjusted to varying asphalt conditions with belt tensioners 34, 134.

A microprocessor is preferably employed to continuously monitor and control the above parameters, and also to monitor and/or calculate and control the yaw rate of each unit. Embodiments are contemplated wherein the compactor speed, steering cylinder yaw, yaw inherent in driving the compactor about a curving path, and asphalt properties are all monitored. Scuffing tends to be more likely to occur with softer asphalt, and there thus exist limits based on the above factors within which the compactor should operate to minimize the risk of scuffing for certain asphalt conditions. For example, a maximum speed and maximum yaw rate parameters will exist for certain asphalt conditions, and the microprocessor may be utilized to limit either or both of compactor speed and or turn radius to minimize the risk that scuffing will occur. These parameters may be set by the microprocessor, for example, by restricting any or all of steer angle, compactor speed or steering system stroke speed under certain operating conditions. In a related vein, compactor speed, yaw rate and asphalt conditions can all be integrated to determine an optimal load distribution on mid rollers 27, 127. The operator controls may further consist of inputs to the microprocessor. The processor can monitor, calculate, and output the appropriate commands needed to perform the operator's wishes.

As compactor 10, 110 completes a turn, load can be redistributed as desired. For particularly tight turning radii, or relatively firm asphalt it may be desirable to support the entire load of each unit on mid rollers 27, 127, operating much the same as a conventional non-belted compactor.

The present description is for illustrative purposes only and should not be construed to narrow the scope of the appended claims. For instance, although each of the illustrated embodiments includes two belted units, this disclosure also contemplates dual units, of which only one is belted. In such a case, the second unit may only be present to facilitate turning (e.g tires and wheels) or may also contribute to compaction (e.g. steerable roller without belt). In some applications, such a hybrid may be desirable. Thus, those skilled in the art will appreciate that various modifications might be made to the presently disclosed embodiments without departing from the full and fair scope of the claims.

What is claimed is:

1. An asphalt compactor comprising:

a first belted compactor unit having a plurality of rollers and a first compactor belt configured for compacting asphalt extending about the plurality of rollers, at least one of said rollers being a drive roller;

a second belted compactor unit having a plurality of rollers and a second compactor belt configured for compacting asphalt extending about the plurality of rollers;

a coupling frame pivotably connected with said first belted compactor unit at a first vertical axis, and pivotably connected with said second belted compactor unit at a second vertical axis, which is different from said first vertical axis;

wherein said asphalt compactor is configured to be passed across hot asphalt distributed by an asphalt paver to compact the same;

a first steering system including a first steering actuator operable to rotate said first belted compactor unit about said first vertical axis relative to said coupling frame;

a second steering system including a second steering actuator operable to rotate said second belted compactor unit about said second vertical axis relative to said coupling frame; and belt heating means configured to heat said compactor belts;

wherein said coupling frame has a first end positioned laterally of said first belted compactor unit, and a second end positioned laterally of said second belted compactor unit, each of said first and second vertical axes being laterally displaced from the respective belted compactor unit, and wherein said asphalt compactor further comprises first and second hoods extending at least partially over said first and second belted compactor units, respectively.

2. The asphalt compactor of claim 1 wherein each of said first and second belted compactor units comprises a load adjuster operable to distribute a weight of the respective unit among the plurality of rollers thereof in a plurality of distributions.

3. The asphalt compactor of claim 1 wherein:

said first compactor belt has a width extending between opposite sides of said first belted compactor unit;

said second compactor belt has a width extending between opposite sides of said second belted compactor unit; and each of said rollers has a width corresponding to the width of the respective compactor belt.

4. The asphalt compactor of claim 1 wherein each of said first and second belted compactor units includes at least three rollers including a front end roller adjacent a front end of each of the front and back frame units, a back end roller adjacent a back end of each of the front and back frame units and at least one mid roller between the front and back end rollers of the corresponding frame unit, the load adjuster of each of said units having a first load distribution configuration wherein a weight of the respective unit is distributed equally among the at least three rollers thereof, and at least one other load distribution configuration wherein a weight of the respective unit is distributed unequally among the at least three rollers thereof.

5. The asphalt compactor of claim 1 wherein said first and second steering systems comprise an overlap adjustment operable to adjust a degree of overlap of said first and second compactor belts.

6. An asphalt compactor comprising:

a first belted compactor unit having a plurality of rollers and a first compactor belt configured for compacting asphalt extending about the plurality of rollers, at least one of said rollers being a drive roller;

a second belted compactor unit having a plurality of rollers and a second compactor belt configured for compacting asphalt extending about the plurality of rollers;

a coupling frame pivotably connected with said first belted compactor unit at a first vertical axis, and pivotably connected with said second belted compactor unit at a second vertical axis, which is different from said first vertical axis;

wherein said asphalt compactor is configured to be passed across hot asphalt distributed by an asphalt paver to compact the same;

a first steering system including a first steering actuator operable to rotate said first belted compactor unit about said first vertical axis relative to said coupling frame;

a second steering system including a second steering actuator operable to rotate said second belted compactor unit about said second vertical axis relative to said coupling frame;

belt heating means configured to heat said compactor belts;

wherein each of said first and second belted compactor units comprises a load adjuster operable to distribute a weight of the respective unit among the plurality of rollers thereof in a plurality of distributions;

wherein each of said first and second belted compactor units includes at least three rollers, the load adjuster of each of said units being operable to distribute a weight of the respective unit among the at least three rollers thereof;

a first lateral position belt guide operably associated with said first belted compactor unit; and a second lateral position belt guide operably associated with said second belted compactor unit;

wherein each of said first and second belt guides includes a guide drum, separate from the plurality of rollers, in contact with the corresponding one of said belts and an actuator operable to reorient the respective guide drum relative to the plurality of rollers of the corresponding belted compactor unit.

7. The asphalt compactor of claim 6 wherein:

said first belt and said second belt each include a first edge and a second edge, an outer surface and an inner surface; and each said guide drum being biased against one of the outer surface and the inner surface of one of said first belt and said second belt and pivotable via the corresponding actuator to guide the belt associated therewith.

8. The asphalt compactor of claim 7 wherein:

said first belted compactor unit and said second belted compactor unit each include a mid roller and two end rollers having diameters different from respective diameters of said mid rollers; and the load adjuster of each of said first and second belted compactor units includes at least one actuator, and is operable to distribute a weight of the respective belted compactor unit among the mid roller and end rollers thereof.

9. The asphalt compactor of claim 8 wherein at least one of the end rollers of each of the first and second belted compactor units comprises a drive roller.

10. The asphalt compactor of claim 8 wherein the at least one mid roller of each of the first and second belted compactor units comprises a drive roller.

* * * * *